US008272359B2

(12) United States Patent
Elnick et al.

(10) Patent No.: US 8,272,359 B2
(45) Date of Patent: Sep. 25, 2012

(54) CAMSHAFT INCLUDING WEIGHT REDUCING FEATURES AND METHOD OF FORMING

(75) Inventors: Rodney K. Elnick, Washington, MI (US); Glenn E. Clever, Washington, MI (US); Shekhar G. Wakade, Grand Blanc, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 412 days.

(21) Appl. No.: 12/720,867

(22) Filed: Mar. 10, 2010

(65) Prior Publication Data

US 2011/0220044 A1 Sep. 15, 2011

(51) Int. Cl.
*F01L 1/04* (2006.01)

(52) U.S. Cl. ..... 123/90.6; 123/90.44; 29/888.1

(58) Field of Classification Search ..... 123/90.44, 123/90.6; 29/888.1
See application file for complete search history.

(56) References Cited

U.S. PATENT DOCUMENTS 5,343,618 A 9/1994 Arnold et al.
7,980,217 B2 * 7/2011 Evans et al. ..... 123/90.6

* cited by examiner

*Primary Examiner* — Ching Chang
(74) *Attorney, Agent, or Firm* — Harness, Dickey & Pierce, P.L.C.

(57) ABSTRACT

A camshaft assembly may include a assembly and a shaft. The cam assembly may include a hollow structure with an interior surface and an exterior surface. A plurality of projections may be located on the exterior surface of the hollow structure. The interior surface of the cam assembly may define a recess axially aligned with at least one of the plurality of projections. At least one of the plurality of projections may define an undercut portion. The cam assembly may be coupled with the shaft.

20 Claims, 5 Drawing Sheets

FIG 3
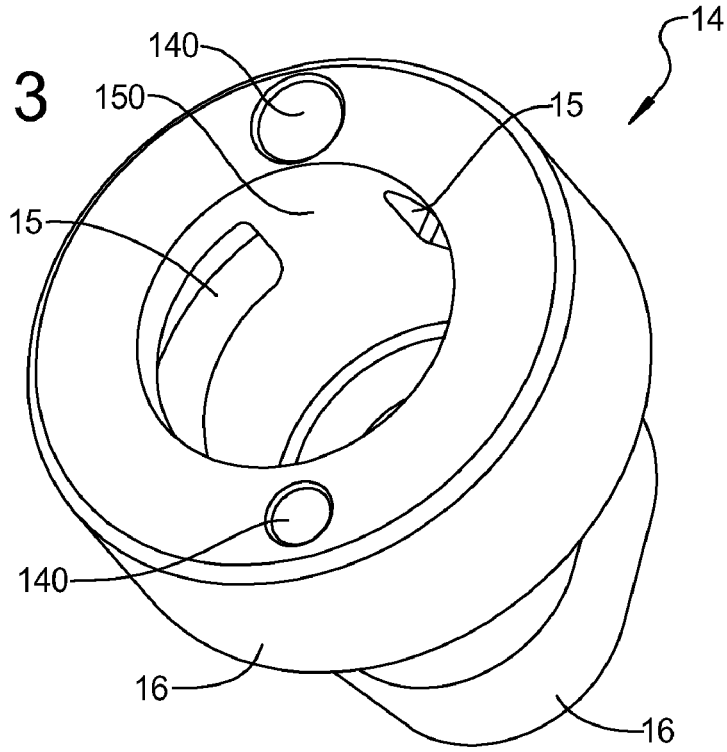
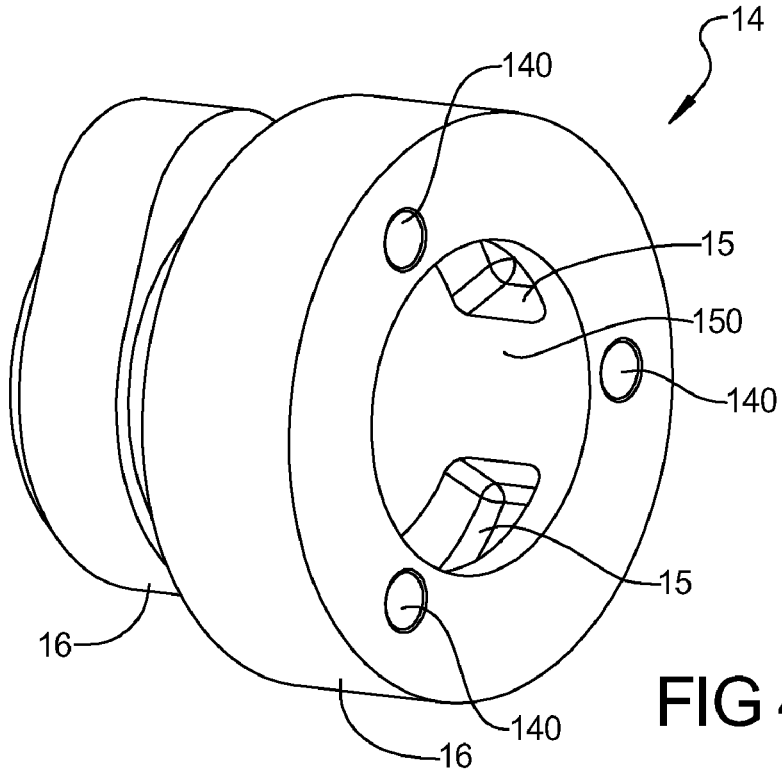
FIG 4

CAMSHAFT INCLUDING WEIGHT REDUCING FEATURES AND METHOD OF FORMING

FIELD

The present disclosure relates to engine camshafts, and more specifically to a lightweight camshaft assembly.

BACKGROUND

This section provides background information related to the present disclosure which is not necessarily prior art.

An engine camshaft assembly may include a plurality of projections, e.g., lobes and main bearing supports or journals, located on the exterior surface of a hollow tube. During operation of the engine, the camshaft assembly is rotated and the lobes act to open the intake and/or exhaust valves of the engine. The journals provide the bearing surface for the support of the camshaft assembly of the engine. The mass of the camshaft affects the efficiency of an engine and, in the case of motor vehicles, fuel economy. Therefore, engine designers typically attempt to reduce the mass of the camshaft assembly by various means.

SUMMARY

This section provides a general summary of the disclosure, and is not a comprehensive disclosure of its full scope or all of its features.

A camshaft assembly may include a shaft and a cam assembly coupled thereto. The cam assembly may comprise a hollow structure with an interior surface and an exterior surface, with a plurality of projections on the exterior surface. The interior surface may define a recess axially aligned with at least one of the plurality of projections. At least one of the plurality of projections may include an undercut portion.

An engine assembly may comprise an engine structure and a camshaft assembly. The camshaft assembly may include a shaft and a cam assembly coupled thereto. The cam assembly may comprise a hollow structure with an interior surface and an exterior surface, with a plurality of projections on the exterior surface. The interior surface may define a recess axially aligned with at least one of the plurality of projections. At least one of the plurality of projections may include an undercut portion.

A method of assembling a camshaft assembly may include providing a shaft and forming a cam assembly. The cam assembly may comprise a hollow structure with an interior surface and an exterior surface, with a plurality of projections on the exterior surface. The interior surface may define a recess axially aligned with at least one of the plurality of projections. At least one of the plurality of projections may include an undercut portion. The cam assembly may be coupled with the shaft.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

FIG. 3 is a perspective view of an exemplary cam assembly according to the present disclosure;

FIG. 4 is a perspective view of an exemplary cam assembly according to the present disclosure;

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
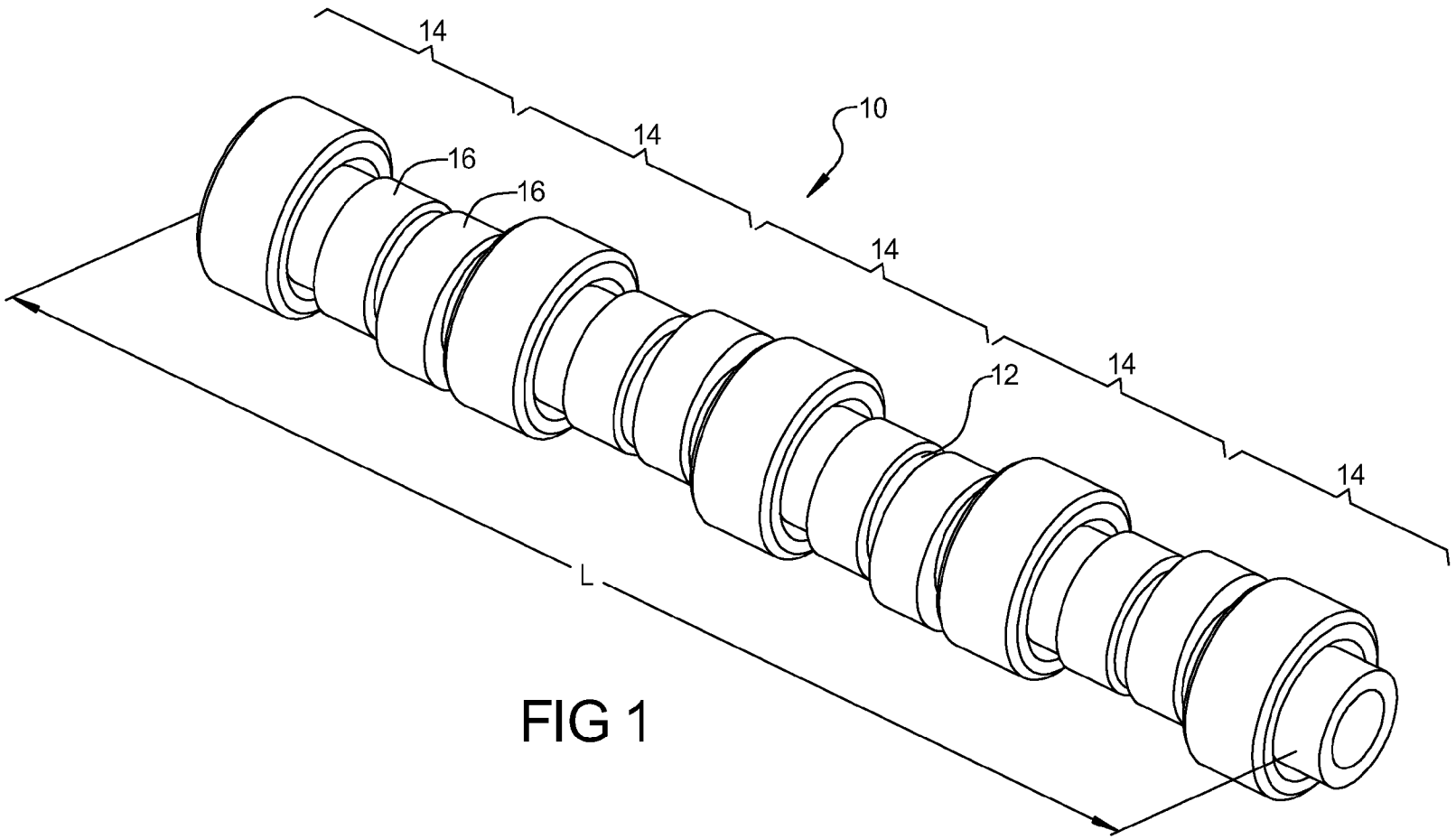
FIG. 1 is a perspective view of an exemplary camshaft assembly according to the present disclosure.

With reference to FIG. 1, a camshaft assembly 10 is illustrated. The camshaft assembly 10 may include a shaft 12 and at least one cam assembly 14. In the example illustrated in FIG. 1, the camshaft assembly 10 includes five cam assemblies 14 distributed along the axial length L of shaft 10. Each cam assembly 14 may include one or more projections 16. The projections 16 of camshaft assembly 10 may be, as a non-limiting example, lobes that are used to operate to open the intake and/or exhaust valves of an engine, as is well-known, and/or journals that are used as main bearing supports for the camshaft assembly 10. In the example illustrated in FIG. 1, the cam assemblies 14 at each end of the camshaft assembly 10 include two projections 16 each (one lobe and one journal) while the three cam assemblies 14 in the middle of the camshaft assembly include three projections each (two lobes and one journal).

Figure 2:
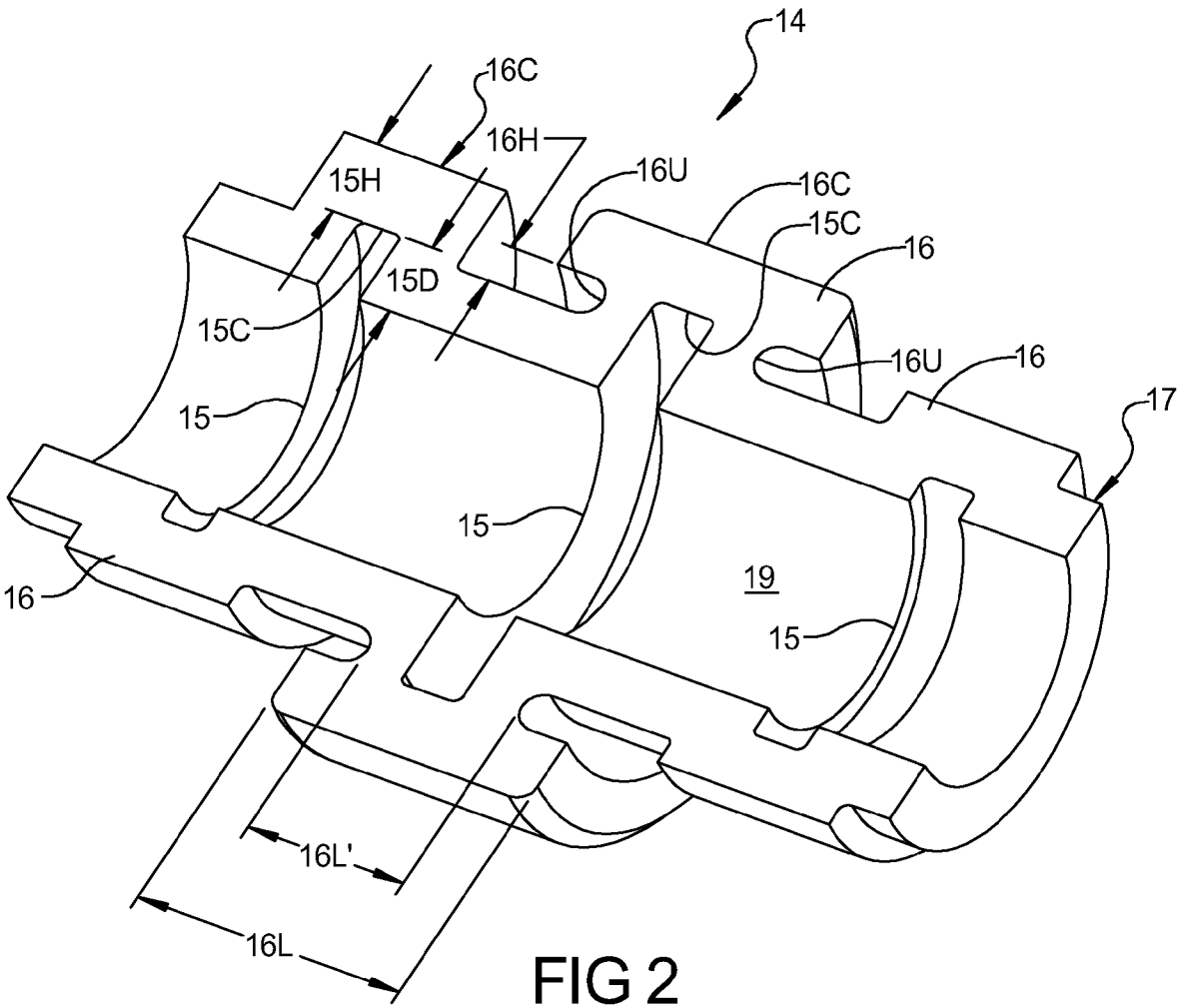
FIG. 2 is a cross-sectional view of the camshaft assembly shown in FIG. 1.

As seen in FIG. 2, cam assembly 14 may be a hollow structure, e.g., a cylindrical tube, that includes an exterior surface 17 and an interior surface 19. Projections 16 may be present on, and extend from, the exterior surface 17. By way of non-limiting example, both the interior and exterior surfaces 17, 19 may be profiled such that the total mass of the cam assembly 14, and associated camshaft assembly 10, may be reduced.

As described above, one or more projections 16 may project from the exterior surface 17 of cam assembly 14. In order to achieve a reduction in mass of the cam assembly 14, all or a subset of the projections 16 may include an undercut portion 16U. The undercut portion 16U may be constructed such that the axial length 16L along the contact surface 16C of the projection 16 is greater than the axial length 16L' along the exterior surface 17 of cam assembly 14. Further, the height of the undercut portion 16H may be increased to maximize the reduction of mass while maintaining the strength, structural integrity and performance of the projection 16 and cam assembly 14.

The interior surface 19 may also be profiled in order to reduce the mass of cam assembly 14. As seen in FIG. 2, for example, all or a subset of the projections 16 may include a recess 15 formed in and defined by the interior surface 19 of the cam assembly 14. The recess 15 may be axially aligned with its associated projection 16. The recess 15 may include a recess depth 15D that may be increased to maximize the reduction of mass while maintaining the strength, structural integrity and performance of the projection 16 and cam assembly 14. The recess depth 15D may vary along the circumference of the cam assembly 14 such that further mass reduction of the cam assembly 14 may be achieved. In one non-limiting example, the recess depth 15D may vary such that a substantially constant material thickness 15H between the interior recess surface 15C and contact surface 16C of the projection 16 is maintained.

With reference to FIGS. 3 and 4, the cam assemblies 14 at each end of the camshaft assembly 10 are illustrated. In the non-limiting examples of FIGS. 3 and 4, the cam assemblies 14 may include one or more coupling openings 140. Coupling openings 140 may be, for example, utilized to couple the assembled camshaft assembly 10 to an engine assembly. Coupling openings 140 may be hollow recesses that extend axially at least partially through a projection 16. In order to accommodate the coupling openings 140, the recess 15 in the projection 16 through which coupling openings 140 extend may be interrupted by and include unrecessed portions 150. Unrecessed portions 150 may be defined by the interior surface 19 of the cam assembly 14. In this manner, the coupling openings 140 may be structurally unaffected, while also reducing the mass of projection 16 by including a recess 15 in appropriate locations.

Figure 5:
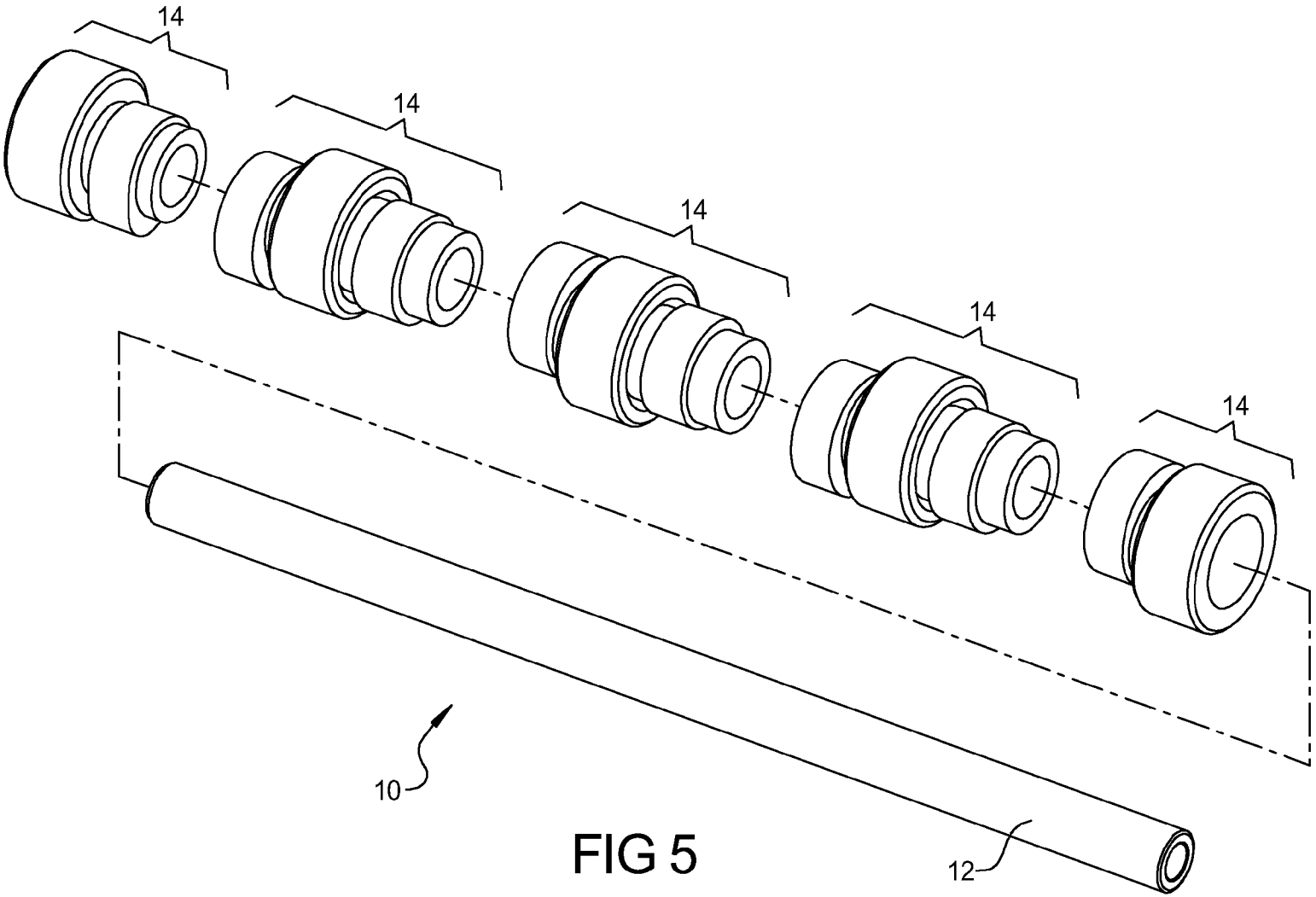
FIG. 5 is a partially exploded perspective view of an exemplary camshaft assembly according to the present disclosure.

With reference to FIG. 5, an exemplary camshaft assembly 10 is illustrated. Shaft 12 may comprise a hollow structure, such as a steel tube, which may be physically coupled with the cam assembly 14. The shaft 12 may be inserted into one or more hollow cam assemblies 14 and frictionally engaged with the interior surface 19, such as by the ballizing method that is described more fully below. In this manner, cam assembly 14 and shaft 12 may be coupled to rotate together.

An exemplary method of manufacturing a camshaft assembly, such as camshaft assembly 10 described above, is described as follows. A shaft 12 may be provided. The shaft 12 may comprise a hollow tube structure, as described above. By way of non-limiting example, the shaft 12 may be a thin walled tube structure that is designed to reduce the mass of shaft 12, while also maintaining the strength, structural integrity and performance of the camshaft assembly 10.

A cam assembly 14 may be formed. In a first non-limiting example, the cam assembly 14 may be formed by an investment casting process. The investment casting process may include the step of forming an investment within a shell of a ceramic or similar material. The shell may be filled with a molten material, e.g., steel, that will be used to form the cam assembly 14. Upon cooling of the material, the shell may be removed, e.g., by hammering, vibration, chemical removal or other process. Alternatively, the shell may begin to crack and fall away from the cam assembly 14 upon cooling. In comparison to other casting processes, the accuracy of an investment reduces the amount of machining to complete the cam assembly 14. In a second non-limiting example, the cam assembly 14 may be formed by a powder metallurgy ("PM") process. With a PM process, however, the coupling of the cam assembly 14 with the shaft 12 (described below) may be accomplished by sinter bonding.

The formed cam assembly 14 may be hardened, for example, by induction hardening, flame hardening, laser hardening or any other hardening process. The cam assembly 14 as a whole may be hardened or individual components of the cam assembly 14, such as projections 16, may be hardened. The hardened cam assembly 14 may then be coupled with shaft 12, which is described more fully below.

The cam assembly 14 and shaft 12 may be coupled by being frictionally engaged with each other, for example, by a ballizing process. In a ballizing process, the cam assembly 14 may be positioned on a hollow, tubular shaft 12. The tubular shaft 12 may then be expanded to hold the cam assembly 14 in position. This may be accomplished by clamping the ends of the shaft 12 to prevent longitudinal growth and forcing a ball (or plurality of balls of increasing diameter) through the tubular shaft 12. The ball or balls are larger than the original shaft 12 inner diameter, thus expanding the shaft 12 to engage cam assembly 14. Other forms of coupling the cam assembly 14 with shaft 12 may also be used, such as sinter bonding, welding, shrink fitting, an expanding mandrel process or any other method.

It is understood that the parts of the camshaft assembly 10 may be coupled to one another in a variety of ways and the present disclosure is not limited to a frictional engagement. For example, in various embodiments the shaft 12 may be formed integrally with the cam assembly 14 to form a monolithic camshaft assembly 10. In these embodiments, the step of coupling the shaft 12 with cam assembly 14 may be eliminated as the shaft 12 and cam assembly 14 may be formed as a single, monolithic piece.

Figure 6:
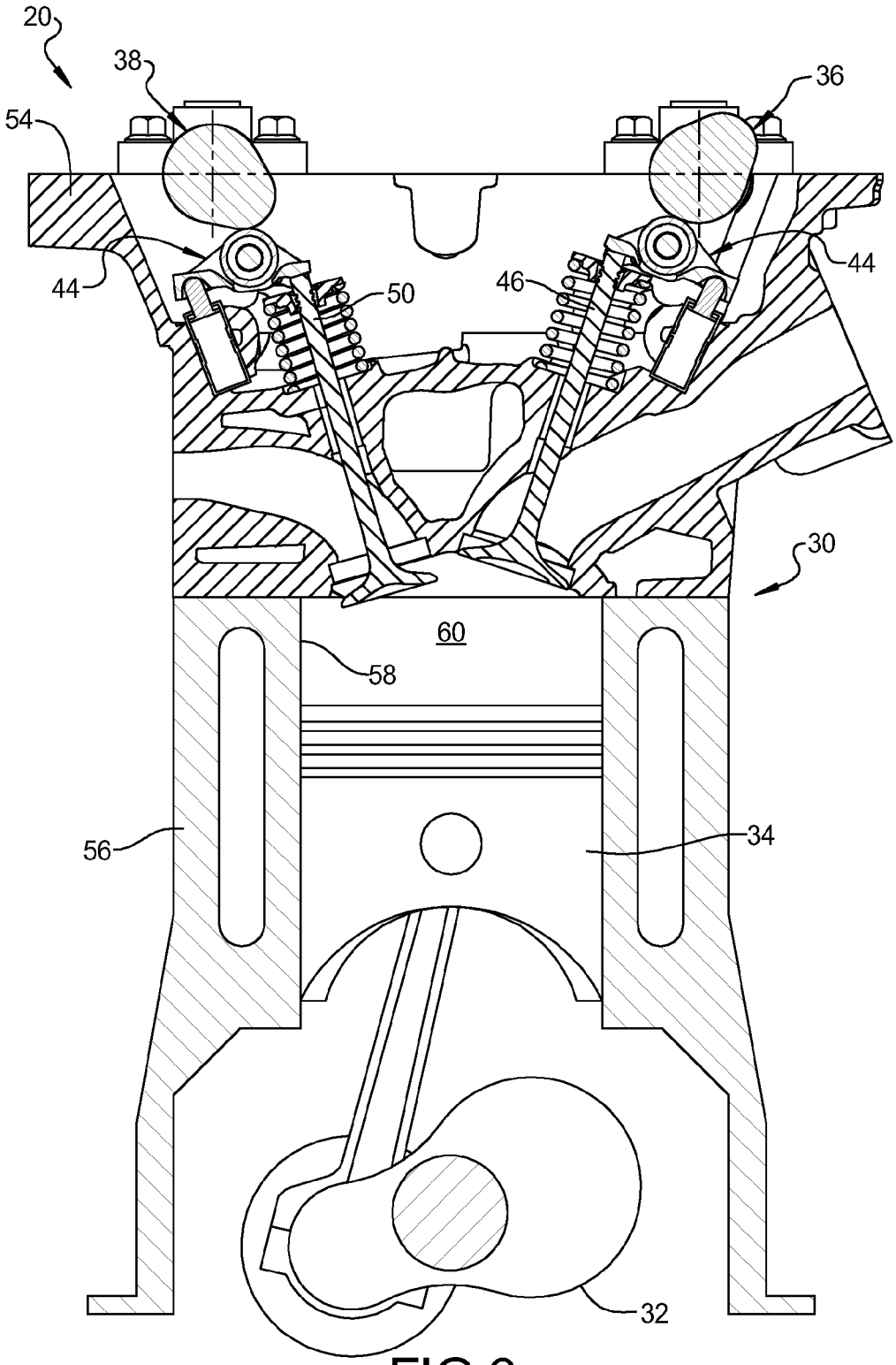
FIG. 6 is a schematic section view of an engine assembly including an exemplary camshaft assembly according to the present disclosure.

With reference to FIG. 6, an engine assembly 20 may include an engine structure 30, a crankshaft 32 rotationally supported by the engine structure 30, one or more pistons 34 coupled to the crankshaft 32, intake and exhaust camshaft assemblies 36, 38 rotationally supported on the engine structure 30, valve lift assemblies 44, at least one intake valve 46, and at least one exhaust valve 50. One or both of the camshaft assemblies 36, 38 may have the structure of camshaft assembly 10 described above. In the present non-limiting example, the engine assembly 20 is shown as a dual overhead camshaft engine with the engine structure 30 including a cylinder head 54 rotationally supporting the intake and exhaust camshaft assemblies 36, 38. However, it is understood that the present disclosure is not limited to overhead camshaft configurations. An engine block 56 may define cylinder bores 58. The cylinder head 54 and the cylinder bores 58 in the engine block 56 may cooperate to define combustion chambers 60.

What is claimed is:

1. A camshaft assembly comprising:

a shaft; and a cam assembly coupled with the shaft, the cam assembly comprising a hollow structure with an interior surface and an exterior surface, and a plurality of projections on the exterior surface, wherein:

the interior surface defines a recess axially aligned with at least one of the plurality of projections, and at least one of the plurality of projections defines an undercut portion.

2. The camshaft assembly of claim 1, wherein the shaft is hollow.

3. The camshaft assembly of claim 1, wherein the shaft is frictionally engaged with the cam assembly.

4. The camshaft assembly of claim 1, wherein the cam assembly is integrally formed with the shaft.

5. The camshaft assembly of claim 1, wherein the cam assembly is manufactured by an investment casting process.

6. The camshaft assembly of claim 1, wherein the recess includes at least one unrecessed portion.

7. The camshaft assembly of claim 1, wherein:

the interior surface defines a recess axially aligned with each of the plurality of projections; and each of the plurality of projections defines an undercut portion.

8. An engine assembly comprising:

an engine structure; and a camshaft assembly including:

a shaft; and a cam assembly coupled with the shaft, the cam assembly comprising a hollow structure with an interior surface and an exterior surface, and a plurality of projections on the exterior surface, wherein:

the interior surface defines a recess axially aligned with at least one of the plurality of projections, and at least one of the plurality of projections defines an undercut portion.

9. The engine assembly of claim 8, wherein the shaft is hollow.

10. The engine assembly of claim 8, wherein the shaft is frictionally engaged with the cam assembly.

11. The engine assembly of claim 8, wherein the cam assembly is integrally formed with the shaft.

12. The engine assembly of claim 8, wherein the cam assembly is manufactured by an investment casting process.

13. The engine assembly of claim 8, wherein the recess includes at least one unrecessed portion.

14. The engine assembly of claim 8, wherein:

the interior surface defines a recess axially aligned with each of the plurality of projections; and each of the plurality of projections defines an undercut portion.

15. A method comprising:

providing a shaft;

forming a cam assembly, the cam assembly comprising a hollow structure with an interior surface and an exterior surface, and a plurality of projections on the exterior surface wherein:

the interior surface of the cam assembly defines a recess axially aligned with at least one of the plurality of projections, and at least one of the plurality of projections defines an undercut portion; and coupling the cam assembly with the shaft.

16. The method of claim 15, wherein forming the cam assembly comprises an investment casting process.

17. The method of claim 15, wherein the recess includes at least one unrecessed portion.

18. The method of claim 15, wherein coupling the cam assembly with the shaft comprises frictionally engaging the cam assembly with the shaft.

19. The method of claim 15, further comprising induction hardening the cam assembly.

20. The method of claim 15, wherein coupling the cam assembly with the shaft comprises a ballizing process.

* * * * *